US005498356A

United States Patent [19]

Kamakura et al.

[11] Patent Number: 5,498,356

[45] Date of Patent: Mar. 12, 1996

[54] REFRIGERANT COMPOSITION CONTAINING CARBODIIMIDE

[75] Inventors: Tamiji Kamakura; Noriyoshi Tanaka; Kimiyoshi Namiwa; Yukio Tatsumi; Masato Namiki; Hideo Yokobori, all of Tokyo, Japan

[73] Assignee: Asahi Denka Kogyo K.K., Tokyo, Japan

[21] Appl. No.: 338,552

[22] Filed: Nov. 18, 1994

[30] Foreign Application Priority Data

Mar. 25, 1993 [JP] Japan ..... 5-066939

[51] Int. Cl.[6] ..... C09K 5/00; C10M 133/16

[52] U.S. Cl. ..... 252/50; 252/68

[58] Field of Search ..... 252/50, 51.5 R, 252/51, 68

[56] References Cited

U.S. PATENT DOCUMENTS

| | | | |
|---|---|---|---|
| 3,346,496 | 10/1967 | Neumannetal | 252/50 |
| 4,029,702 | 6/1977 | Piccolini | 252/51.5 A |
| 4,098,710 | 7/1978 | Elliott et al. | 252/51.5 A |
| 4,467,395 | 8/1984 | Ross | 252/575 |
| 4,490,266 | 12/1984 | Hentschel et al. | 252/56 R |

FOREIGN PATENT DOCUMENTS

| | | |
|---|---|---|
| 166998 | 1/1986 | European Pat. Off. . |
| 411750 | 2/1991 | European Pat. Off. . |
| 448402 | 9/1991 | European Pat. Off. . |
| JP-A50044 | 1/1975 | Japan |
| 144982B | 2/1975 | Netherlands . |

OTHER PUBLICATIONS

Derwent English language abstract of Dutch 144,982B. (no date) (Feb. 1975).

*Primary Examiner*—Stephen Kalafut
*Assistant Examiner*—James M. Silbermann
*Attorney, Agent, or Firm*—Olson & Hierl, Ltd.

[57] ABSTRACT

The present invention relates to a lubricated refrigerant for use in refrigerators employing hydrofluorocarbon coolants such as R 134*a*, R 32, R 125 and the like. The lubricated refrigerant contains fluorocarbon coolant, synthetic oil and a carbodiimide compound represented by the following general formula. $R_1$—N=C=N—$R_2$, wherein $R_1$ and $R_2$ represent hydrogen atoms or hydrocarbly groups or nitrogen and/or oxygen containing hydrocarbly groups, and $R_1$ and $R_2$ may be the same or different groups. The refrigerant composition according to the present invention preferably contains said hydrofluorocarbon coolant and said lubricant at a given blending ratio.

17 Claims, No Drawings

REFRIGERANT COMPOSITION CONTAINING CARBODIIMIDE

INDUSTRIAL FIELD OF APPLICATION

The present invention relates to a lubricant for use in refrigerators and a refrigerant composition using same, more specifically, to a lubricant for use in refrigerators employing a hydrofluorocarbon coolant such as R 134 a (1,1,1,2-tetrafluoroethane: Flon 134a), R 32 (difluoromethane: Flon 32), R 125 (pentafluoroethane: Flon 125) and the like and a refrigerant composition using same.

BACKGROUND OF THE INVENTION

(a) PRIOR ART

Hydrocarbon coolants containing fluorine and chlorine such as chlorofluorocarbons and hydrochlorofluorocarbons have conventionally been considered excellent for use as coolants for refrigerators as they are chemically stable and have low toxicity. However, the recent Montreal Protocol decided that the use of chlorofluorocarbons, for example R 12 (dichlorodifluoromethane: Flon 12) shall be totally abolished by the year 1996, because chlorofluorocarbons cause damage to the ozone layer in the stratosphere and thereby contribute to global warming.

While, hydrochlorofluorocarbons such as R 22 (monochlorodifluromethane: Flon 22) have been expected to be used as alternatives to R 12, various countries are conferring in order to abolish the use of R 22 by the early twenty-first century, since there is an uneasiness concerning its damage to the ozone layer.

Based on such circumstances, R 134a and a mixture of R 134a and R 32 have been noted as alternatives to R 12 and R 22 respectively. Also, hydrocarbon coolants which do not contain chlorine in their molecular compositions such as hydrofluorocarbon coolants as represented above have been expected to be used in the feature as coolants.

However, because the polarity of hydrofluorocarbon coolants such as R 134a, R 32 and the like is higher than that of R 12 or R 22, these hydrofluorocarbon coolants have poor compatibility with naphthene mineral oils, alkylbenzenes and the like which have been conventionally employed as lubricants for refrigerators. In order to improve upon said disadvantage as lubricants for use in refrigerators using hydrofluorocarbon coolants, lubricants comprising polyoxyalkylene glycol has been described in U.S. Pat. No. 4,755,316, Japanese Patent Laid-Open No. 03-28296 and the like and lubricants comprising esters have been proposed in Japanese Patent Laid-Open Nos. 03-505602, 03-88892, 03-128991, 03-128992 and the like.

Since small amounts of water exist in compressors of refrigerators, if a compound having an ester linkage is present in the refrigerator oils, there is the problem that the ester linkage may be hydrolyzed to form free acid and said free acid may cause corrosion and sludge.

In order to improve on said disadvantages, the use of a glycidyl ether type epoxy compound and epoxidized vegetable oil as stabilizing agents has been proposed in Japanese Patent Published No. 60-19352, the use of a glycidyl ether type compound having superior compatibility with R 134a has been proposed in Japanese Patent Laid-Open Nos. 03-275799 and 04-55498, and the use of an alicyclic epoxy compound has been proposed in Japanese Patent Laid-Open No. 05-105896.

While polyoxyalkylene glycols are relatively stable against hydrolysis, they have poor heating oxidation stability and lubricating properies. Consequently, when they are subjected to heating oxidation, not only do their molecular weights decrease but they also generate acidic substances which may cause corrosion of materials used in refrigerators. Furthermore, their poor lubricating properties cause some problems such as slight vibrations and an increase in wear of devices in refrigerators.

In order to improve on these problems, for example, Japanese Patent Laid-Open No. 02-102296 discloses refrigerator lubricants which are composed of polyoxyalkylene glycol blended with antioxidant (e.g. phenol-, amine-, phosphorous- and benzotriazole-based one) and a phosphorous-based antiwear agent, and Japanese Patent Laid-Open No. 02-84491 discloses refrigerator lubricants which are composed of polyoxyalkylene glycol monoalkyl ether blended with an epoxy compound and a phosphorous-based antiwear agent.

(b) PROBLEMS THE INVENTION AIMS TO SOLVE

However, since the glycidyl ether type epoxy compounds and epoxidized vegetable oil described in Japanese Patent Published No. 60-19352 were used in chlorofluorocarbon and hydrochlorofluorocarbon coolants containing chlorine in their molecular structures, such as R 12, R 22 and the like, in fact said epoxidized vegetable oil and the like have poor compatibility with R 134a, thereby exerting various bad influences in the compressor.

On the other hand, the glycidyl ether type epoxy compounds having superior compatibility with R 134 a proposed in Japanese Patent Laid-Open Nos. 03-275799 and 04-55498 invariably have chlorine remaining in their products and are thus not preferable when considering the environment, and further there is a disadvantage in that the inhibition of corrosion by free acids and the like that is produced is insufficient, since said epoxy compound is slowly reacted with free acids and the like to form sludge by polymerization on the sliding surface.

Further, although there is an advantage in that this alicyclic epoxy compound has no chlorine, sufficient properties can not be obtained since said compound reacts slowly with free acids and the like, therefore leaving much room for improvement.

Among the antioxidants described in Japanese Patent Laid-Open No. 02-102296, those based on amine and phosphorous may possibly corrode materials used in refrigerators and therefore can not be used practically, and those based on benzotriazole and phenol still do not impart sufficient antioxidation effects.

On the other hand, the epoxy group-containing compounds described in Japanese Patent Laid-Open No. 02-84491 have some disadvantages in that they may cause polymerization on the sliding surface in the compressor, resulting in the production of sludge. Also, they can not sufficiently inhibit the corrosion caused by acidic substances occuring from heat oxidation of polyoxyalkylene glycol since they barely react with the acidic substances.

Although the insufficient lubricating properties of polyalkylene glycol can be improved by using a phosphorous-based antiwear agent in combination, the antiwear agent is readily hydrolyzed with any trace amounts of water involved in the refrigerator and therefore may be a cause of corrosion. Furthermore, the hydrolysate of the phosphorous-based antiwear agent acts as a catalyst for heating-oxidative degradation of polyalkylene glycol as well, which affects the stability of polyalkylene glycol.

Dutch Patent No. 144982 discloses a lubricating oil composition containing a carbodiimide compound. In this patent, it is described that the composition is improved in its oxidation stability, but there is no description about its hydrolysis stability and there is also no disclosure or suggestion that it can be used as a refrigerator lubricating oil.

Particularly, in refrigerator lubricating oils in general, the important factor is compatibility with the refrigerant used. If the lubricating oil has poor compatibility with a refrigerant, expansion valves and capillary or strainer portions of the refrigerator become blocked. As a result, pressure loss arises and occasionally something goes wrong with the refrigerator itself. In the Dutch Patent described above, however, there is no description of the use of said carbodiimide compound for a refrigerator. In addition, there is also no description concerning the compatibility of said compound with the so-called regulated chlorofluorocarbons such as R 12 and hydrochlorofluorocarbons such as R 22 that have already been decided to be entirely abolished, or with hydrofluorocarbons such as R 134a and R 32 which are expected to be replacements for said regulated chlorofluorocarbons and hydrochlorofluorocarbons. Therefore, it is questionable that said carbodiimide compound can be used for refrigerator lubricating agents.

Accordingly, it is an object of the present invention to provide a lubricant for use in refrigerators containing a stabilizing agent reacting smoothly with free acids and/or acidic materials, which has superior compatibility with hydrofluorocarbon coolants such as R 134a and the like, and a refrigerant composition containing said hydrofluorocarbon coolants and said lubricant.

BRIEF SUMMARY OF THE INVENTION

The present inventors, as a result of having made various studies regarding lubricants for use in refrigerators have achieved the present invention.

According to the present invention, there is provided a lubricant for use in refrigerators employing hydrofluorocarbon coolants comprising compounding synthetic oil and carbodiimide compounds represented by the following general formula as the molecule:

$$R_1—N=C=N—R_2 \quad (1)$$

wherein $R_1$ and $R_2$ represent hydrogen atoms, hydrocarbyl groups or nitrogen and/or oxygen containing hydrocarbyl groups, and where $R_1$ and $R_2$ may be the same or different groups.

In above general formula (1), $R_1$ and $R_2$ may be hydrogen atoms, hydrocarbyl groups or nitrogen and/or oxygen containing hydrocarbyl groups, and said $R_1$ and $R_2$ may be the same or different groups.

In the general formula (1), compounds where $R_1$ and $R_2$ are hydrogen atoms, aliphatic hydrocarbon groups having 1 to 12 carbon atoms, aromatic hydrocarbon groups or aromatic-aliphatic hydrocarbon groups having 6 to 18 carbon atoms are preferable, and concretely said compounds contain as $R_1$ and $R_2$ for example hydrogen atom, alkyl groups such as methyl, ethyl, propyl. isopropyl, butyl, isobutyl, pentyl, 2-methylbutyl, hexyl, heptyl, octyl, 2-ethylhexyl, nonyl, decyl, undecyl, dodecyl and the like, alkenyl groups such as propenyl, butenyl, isobutenyl, pentenyl, 2-ethylhexenyl, octenyl and the like, cycloalkyl groups such as cyclopentyl, cyclohexyl, methylcyclopentyl, ethylcyclopentyl and the like, aryl groups such as phenyl, naphtyl and the like, alkyl substituted aryl groups such as alkyl substituted phenyl groups for example toluyl, isopropylphenyl, diisopropylphenyl, triisopropylphenyl, nonylphennyl and the like, aralkyl groups such as benzyl, phenetyl and the like.

DETAILED DESCRIPTION

The solubility with synthetic oil as well as hydrofluorocarbon coolants of these compounds has a tendency to lower if the number of carbon atoms increase and the boiling point of these compounds also has a tendency to lower if the number of carbon atoms decrease. Further, carbodiimide compounds having higher polarity are preferable, since hydrofluorocarbon coolants and synthetic oils for use in refrigerators have comparatively high polarity.

Therefore, it is more preferable that the carbodiimide compounds have as $R_1$ and $R_2$ alkyl groups having 3 to 6 carbon atoms as aliphatic hydrocarbon groups, allyl or alkyl substituted phenyl groups having 6 to 15 carbon atoms as aromatic and aromatic-aliphatic hydrocarbon groups with such carbodiimide compounds being illustrated by those containing propyl, isopropyl, butyl, isobutyl, pentyl, 2-methylbutyl, hexyl, phenyl, toluyl, isopropylphenyl, diisopropylphenyl, triisopropylphenyl groups and the like as $R_1$ and $R_2$.

Also, as the carbodiimide compounds used in the present invention, among said compounds indicated by the above general formula (1) carbodiimide compounds having substituent group represented by the following general formula as $R_1$ and $R_2$ may be illustrated:

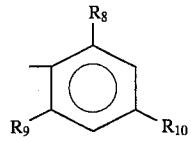

(2)

wherein $R_8R_9$ and $R_{10}$ represent independently hydrogen atoms or alkyl groups having 1 to 10 carbon atoms, and where in said compound $R_1$ and $R_2$ may be the same group or different groups.

The carbodiimide compounds in which $R_1$ and $R_2$ are substituted with the substituent groups represented by the general formula (2) above are most suitable as additives for refrigerators, since they have excellent stability as the reaction products with free acids and acidic substances and excellent solubility with synthetic oils and hydrofluorocarbons. It is considered that this is because the benzene ring in the aryl group and/or alkylaryl group, which are substituted with the substituent represented by the formula (2) above, improves the stability of the reaction products and the solubility with synthetic oils and hydrofluorocarbon coolants.

In the above formula (2), $R_8$, $R_9$ and $R_{10}$ may be hydrogen atoms or alkyl groups having 1 to 10 carbon atoms. For example, $R_8$, $R_9$ and $R_{10}$ may be illustrated by hydrogen atom, methyl, ethyl, propyl, isopropyl, butyl, isobutyl, t-butyl, pentyl, isopentyl, hexyl, isohexyl, heptyl, isoheptyl, octyl, isooctyl, 2-ethylhexyl, nonyl, isononyl, 3,5,5-trimethylhexyl, decyl, isodecyl group and the like.

Preferably, $R_8$, $R_9$ and $R_{10}$ are selected so that the total number of carbon atoms contained in $R_8$, $R_9$ and $R_{10}$ is not more than 12, from the viewpoint of the solubility of the reaction products with free acids and acidic substances to synthetic oils and hydrocarbon coolants. Therefore, among the examples described above, hydrogen atoms, and methyl, ethyl, propyl, isopropyl, butyl, isobutyl and t-butyl groups are particularly preferable.

Further, as the carbodiimide compounds used in the present invention compounds having the following general formula and two or more functional groups may be illustrated:

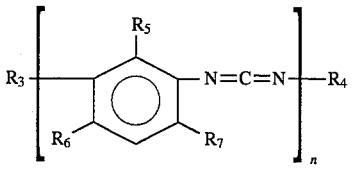

(3)

wherein $R_3$ represents a hydrogen atom or an alkyl group having 1 to 10 carbon atoms, R4 represents a hydrogen atom or an alkyl group having 1 to 10 carbon atoms or a substitutent group indicated by the following general formula:

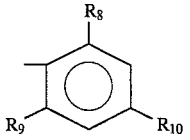

(2)

wherein $R_5$, $R_6$, $R_7$, $R_8$, $R_9$ and $R_{10}$ represent hydrogen atoms or alkyl groups, the total number of carbon atoms contained in $R_5$, $R_6$ and $R_7$ is not more than 10, the total number of carbon atoms contained in $R_8$, $R_9$ and $R_{10}$ is also not more than 10, and $n \geqq 2$.

It is not preferable that the total number of carbon atoms contained in $R_5$, $R_6$ and $R_7$ or $R_8$, $R_9$ and $R_{10}$ in this compound is more than 10, because the solubility with synthetic oils or hydrofluorocarbon coolants may be decreased. Concretely, methyl, ethyl, isopropyl, propyl, butyl, isobutyl, pentyl, hexyl, heptyl, 2-ethylhexyl, nonyl, isodecyl groups and the like may be illustrated. From the viewpoint of the solubility of the carbodiimide compounds with synthetic oils and hydrofluorocarbon coolants, among the examples described above, methyl, ethyl, isopropyl and propyl groups are particularly preferable.

Among the carbodiimide compounds described above, from a comprehensive view of stability and compatibility with new oils (i.e. unused oils) or degraded oils (i.e. used oils), reactivity with acidic substances and stability and compatibility of the reaction product with acidic substances in the presence of both a synthetic oil and a hydrofluorocarbon coolant, bis(isopropylphenyl)carbodiimide, bis(diisopropylphenyl)carbodiimide and bis(triisopropylphenyl-)carbodiimide are most preferable.

In the carbodiimide compounds used in the present invention indicated by the above general formula (3) and having two or more functional groups in the molecule, n may range from 2 to 6, but it is preferable that n be limited from 2 to 3, since the solubility with synthetic oils and/or hydrofluorocarbon coolants has a tendency to lower with an increase in the value of n.

The amount of the above carbodiimide compounds added in the present invention may be from 0.05 to 15 parts by weight, more preferably from 0.1 to 10 parts by weight, most preferably from 0.3 to 5 parts by weight to 100 parts by weight of synthetic oils for refrigerators. If this amount is lower than the above range, no effects from adding said compounds can be obtained and if this amount is higher than the above range, the effect of adding these compounds may only be slightly increased and conversely cause such problems as a lack of lubricity and the like.

The synthetic oils used in the present invention may be those of from 2 to 50 cSt of kinematic viscosity at 100° C., for example polyoxyalkylene glycol and the modified products thereof, neopentyle polyol ester, dibasic acid ester. polyester, carbonate, aromatic polybasic acid ester, fluorinated oil and the like, and they may be used singly or in mixtures of two or more thereof.

Further, since the optimum temperature of the refrigeration cycle may differ according to kind of refrigerator and the use thereof, preferable compatible temperature ranges between hydrofluorocarbon coolants and lubricants for use in the refrigerator can not be generally indicated. However, in quick-freezing apparatuses and the like, for example, said temperature range may be from −60° to 50° C., in small size domestic refrigerators said temperature range may be from −40° to 80° C., in room air conditioners said temperature range may be from −20° to 50° C., in automotive air conditioners said temperature range may be from −20° to 80° C., and in room air conditioners in tropical regions said temperature range may not be less than 0° C.

Since the lubricants whose molecules do not contain chlorine for use in refrigerators according to the present invention can improve the stability of refrigerator lubricants, particularly those having an ester linkage, the effects of the present invention are sufficiently exhibited when synthetic oils having ester linkages are used as the base oil.

These synthetic oil may be illustrated by acylating modified products of polyoxyalkylene glycol, neopentyl polyol ester, dibasic acid ester, polyester, carbonate, aromatic polybasic acid ester and the like.

More concretely, these synthetic oils are modified products of polyoxyalkylene glycol which may be illustrated by acylating products of polyoxyethylenepolyoxypropylene glycol having molecular weight of from 200 to 3000, acylating product of polyoxypropylene glycol having a molecular weight of from 200 to 3000 and the like wherein said polyoxyethylenepolyoxypropylene glycol may be random or in block form.

The neopentyl polyol ester may be illustrated by esters of aliphatic carboxylic acid having 2 to 18, preferably 2 to 9 carbon atoms with neopentyl polyol such as neopentyl glycol, trimethylolethane, trimethylolpropane, pentaerythritol, dipentaerythritol and the like.

The dibasic acid ester may be illustrated by esters of divalent carboxylic acid having 4 to 12 carbon atoms such as adipic acid, sebacic acid, azelaic acid, phthalic acid and the like with primary alcohol or secondary alcohol having from 4 to 18 carbon atoms.

The polyester may be crosslinked esters of divalent carboxylic acid having 4 to 12 carbon atoms with polyhydric alcohol having 4 to 18 carbon atoms, and compounds in which the terminal functional group is ester linked with aliphatic carboxylic acid having 4 to 12 carbon atoms or primary or secondary alcohol having 4 to 12 carbon atoms may be mentioned.

The carbonate compound may be illustrated by polycarbonate compounds of polyoxyethylenepolyoxypropylene glycol and the like as described in Japanese Patent Laid-Open Nos. 03-217495, 04-18940, 04-63893 and the like.

The aromatic polybasic acid ester may be illustrated by esters of aromatic polyvalent carboxylic acid such as pyromellitic acid, trimellitic acid and the like with primary alcohol or secondary alcohol having 1 to 8 carbon atoms.

The synthetic oils described above may be used singly or in mixtures of two or more thereof.

Among these synthetic oils that can be used in the present invention, neopentyl polyol esters are preferable as synthetic oils having an ester linkage. Since neopentyl polyol esters have greater electric insulation properties than modified products of polyoxyalkylene glycol, are superior to carbonate compounds that generate carbon dioxide gas, have greater heat resistance than dibasic acid esters or polyesters, and have better lubricity than aromatic polybasic acid esters, the use of neopentyl polyol ester is preferable particularly when the lubricants according to the present invention are used in closed type refrigerators.

Neopentyl polyols that constituted said neopentyl polyol ester are not limited and may be those having a neopentyl configuration and two or more hydroxyl groups. Such neopentyl polyols may be illustrated by neopentyl glycol, trimethylol propane, trimethylol ethane, ditrimethylol propane, ditrimethylol ethane, pentaerythritol, dipentaerythritol, tripentaerythritol and the like, and these neopentyl polyols may be used singly or in mixtures of two or more thereof.

Fatty acids that constituted said neopentyl polyol ester may be one or a mixture of two or more of saturated fatty acids having a linear chain and/or branched chain, but it is preferable that these saturated fatty acids having linear chains and/or branched chains have 4 to 10 carbon atoms of linear part of said fatty acid (if a mixture of two or more of the fatty acids are used, said carbon atom number is a mean carbon atom number). The saturated fatty acid may for example, be illustrated by n-butanoic acid, isopentanoic acids such as 2-methylbutanoic acid, 3-methylbutanoic acid and the like, n-pentanoic acid, isohexanoic acids such as 2-methylpentanoic acid, 3-methylpentanoic acid and the like, n-hexanoic acid, isoheptanoic acids such as 2-methylhexanoic acid, 2-ethylpentanoic acid, 3-methylhexanoic acid, 5-methylhexanoic acid and the like, n-heptanoic acid, isooctylic acids such as 2-ethylhexanoic acid, 3,5-dimethylhexanoic acid, 4,5-dimethylhexanoic acid, 4-methylpentanoic acid and the like, n-octylic acid, isononanoic acids such as 3,5,5-trimetylhexanoic acid and the like, n-nonanoic acid, isodecanoic acid, n-decanoic acid, isododecanoic acid, n-dodecanoic acid, isoundecanoic acid, n-undecanoic acid, isotridecanoic acid, isomyristic acid, isopalmitic acid, isostearic acid, 2,2-dimethylbutanoic acid, 2,2-dimethylpentanoic acid, 2-ethyl-2-methylbutanoic acid, 2,2-dimethylheptanoic acid, 2,2,4,4,-tetramethylpentanoic acid, and neo acids such as neononanoic acid, neodecanoic acid and the like.

The carbon atom number of the linear part of that fatty acid that is described hereinbefore refers to the carbon atom number of the longest carbon chain. For example, the carbon atom number of 2-ethylhexanoic acid is 6.

Among these neopentyl polyol esters, if R 134a is used alone as a hydrofluorocarbon coolant and mixed coolant such as a mixture of R 134a and R 32 or R 134a, R 32 and R 125, the following neopentyl polyol esters are preferable.

Neopentyl polyol esters meeting the following formula:

$$0 \leqq (Y-4)\times(X+3)/Y \leqq 3.5$$

and, most preferably $$0 \leqq (y-4)\times(X+3)/Y \leqq 3$$

wherein X represents the average hydroxyl group number per neopentyl polyol molecule and Y represents the average carbon number of the linear part of the saturated fatty acid having a linear chain and/or branched chain. It is not preferable that the value of the above formula be too low, as there is a tendency for the lubricity to be insufficient or for the value to be too high, since there are tendencies for the compatibility with hydrofluorocarbon coolants to become too low and for the pour point to increase. Further, from the viewpoint of compatibility with hydrofluorocarbon coolants, it is preferable that said value ranges are not more than 3 among the range of said formulas.

These neopentyl polyol esters may be illustrated by 3,5,5-trimethylhexanoate of neopentylglycol, n-nonanoate of neopentylglycol, 2-ethylhexanoate of neopentylglycol, n-heptanoate of trimetylolpropane, 2-ethylpentanoate of trimetylolpropane, 2-ethylhexanoate of trimethylolpropane, esters of mixed 2-methylhexanoic and 2-ethylhexanoic acids with trimethylolpropane, esters of mixed 2-methylhexanoic and 2-ethylhexanoic acids with pentaerythritol, esters of mixed 2-methylhexanoic and 2-ethylpentanoic acids with pentaerythritol, esters of mixed 2-methylhexanoic, 2-ethylpentanoic and 2-ethylhexanoic acids with pentaerythritol, n-hexanoate of pentaerythritol, 2-ethylhexanoate of pentaerythritol, 2-ethylpentanoate of ditrimethylolpropane. esters of mixed 2-ethylbutanoic and n-hexanoic acids with dipentaerythritol, n-pentanoate of dipentaerythritol, esters of mixed 2-ethylbutanoic and 2-ethylpentanoic acids with tripentaerythritol and the like.

In some kinds of refrigerators, contamination of water sometimes occurs continuously or intermittently. In such cases, a mixture of polyoxyalkylene glycol and its alkyl ether with a phenol-type antioxidant is more preferably used than the synthetic oils which contain ester bonds.

As polyoxyalkylene glycols and their alkyl ethers to be used in the present invention, there can be employed the compounds represented by the following general formula:

$$Z[O(AO)_m R_{11}]_1 \quad (4)$$

wherein Z represents an alcohol residue having 1 to 8 hydroxyl groups, A represents an alkylene group having 1 to 4 carbon atoms, $R_{11}$ represents a hydrogen atom or alkyl group having 1 to 8 carbon atoms and may be the same group or different groups, m is $1 \leqq m \leqq 80$, p is $1 \leqq p \leqq 8$ and $1 \leqq m \times p \leqq 300$.

In the formula (4) above, A represents an alkylene group, which may be illustrated by a methylene group, ethylene group, isopropylene group, propylene group, isobutylene group, butylene group and the like, and among them, from the viewpoint of hygroscopicity, lubricating properties and compatibility with hydrocarbons, the ethylene group, isopropylene group and isobutylene group are preferable. Since an increase in the number of ethylene groups tends to reduce the low temperature fluidity of the compound and to increase its hygroscopicity, it is more preferable to employ ethylene, isopropylene and isobutylene in the ratio of ethylene: isopropylene+isobutylene=0~1:1.

In the formula (4) above, $R_{11}$ represents a hydrogen atom or an alkyl group having 1 to 8 carbon atoms and may be the same group or different groups, may be illustrated by hydrogen atoms, methyl, ethyl, isopropyl, propyl, isobutyl, t-butyl, butyl, pentyl, hexyl, heptyl, octyl, 2-ethylhexyyl and the like, and among these, the hydrogen atoms, methyl, ethyl, isopropyl, propyl and isobutyl are preferable from the viewpoint of compatibility with hydrofluorocarbon coolants.

In the formula (4) above, Z represents an alcohol residue having 1 to 8 hydroxyl groups and as the raw materials of the alcohol residues, for example, monovalent alcohols such as methanol, ethanol, propanol, isopropanol, butanol, isobutanol, t-butanol, pentanol, hexanol, heptanol, octanol, 2-ethylhexanol and the likes and polyhydric alcohols for example polyols such as ethylene glycol, propylene glycol, isopropylene glycol, butylene glycol, isobutylene glycol, glycerin, erythritol and the like; polyglycerins such as diglycerin, triglycerin, tetraglycerin and the like; neopentyl polyols such as neopentylglycol, trimetylolpropane, pentaerythritol, ditrimethlolpropane, dipentaerythritol and the like; sugars such as glucose, sorbitol, sucrose and the like can be employed, and among these, from the viewpoint of compatibility with hydrofluorocarbon coolants and stability, methanol, ethanol, isopropanol, isobutanol, ethylene glycol, propylene glycol, isopropylene glycol, glycerin, neopentyl glycol, and trimethylolpropane are preferable.

In the formula (4) above, m represents the polymerization degree of alkylene group, p represents the number of hydroxyl groups of the alcohol, m and p may be satisfied within the ranges of $1 \leqq m \leqq 80$, $1 \leqq p \leqq 8$, and $1 \leqq m \times p \leqq 300$, and those in which m and p are over the range are not preferable since the compatibility of hydrofluorocarbon coolants becomes lower. On the other hand, even though m and p are within the range a decrease in m and m×p tends to decrease the lubricating property of the compounds, whereas an increase in m and m×p tends to decrease the compatibility of hydrofluorocarbon coolants and an increase in p tends to lower their stability. From these reasons m and p preferably satisfy the range of $1 \leqq m \leqq 70$, $1 \leqq p \leqq 6$ and $5 \leqq m \times p \leqq 200$, and more preferably satisfy the range of $5 \leqq m \leqq 60$, $1 \leqq p \leqq 3$ and $5 \leqq m \times p \leqq 150$.

The compound of the formula (4) may be a random or block polymer, or combination form of random and block polymers.

In the mixture of polyoxyalkylene glycol and its alkyl ether with a phenol-type antioxidant used in the present invention, any compounds known as conventional antioxidants can be employed as phenol-type antioxidants so long as they contain one or more phenolic hydroxyl groups per molecule and examples of such phenol-type antioxidants may be illustrated by monophenol-type antioxidants such as 2,6-di-t-butyl-p-cresol, 2,6-di-t-butyl-4-ethyl-phenol, 2,6-di-t-butyl-phenol, 2,4-dimethyl-6-t-butyl-phenol, butylhydroxyanisole, stearyl-β-(3,5-di-t-butyl-4-hydroxyphenyl-)propionate, alkylated phenols, styrenated phenol tocopherol and the like; bisphenol-type antioxidants such as 2,2'-methylenebis(4-metyl-6-t-butylphenol), 2,2'-methylenebis(4-ethyl-6-t-butylphenol), 4,4'-thiobis(3-methyl-6-t-butylphenol), 4,4'-butylidenebis(3-methyl-6-t-butylphenol), 3,9-bis{1,1-dimethyl-2-[β-(3-t-butyl-4hydroxy5-methylphenyl)propyonyloxy]ethyl}-2,4,8,10-tetraoxaspiro(5,5)undecane and the like; higher molecule phenol-type antioxidants such as 1,1,3-tris(2-methyl-4-hydroxy-5-t-butylphenyl)butane, 1,3,5-trimethyl-2,4,6-tris(3,5-di-t-butyl-4-hydrooxybenzyl) benzene, tetrakis[methylene-3-(3,5-di-t-butyl-4'-hydroxyphenyl) propionate] methane, bis[3,3'-bis-(4'-hydroxy-3'-t-butylphenyl) butyric acid]glycol ester, 1,3,5-tris(3',5'-di-t-butyl-4'-hydroxybenzyl)-S-triazine-2,4,6-(1H, 3H, 5H)trione and the like; and polyphenol-type antioxidants such as 2,5-di-t-butylhydroquinone, 2,5-di-t-amylhydroquinone and the like.

Among these phenol-type antioxidants, from the viewpoint of compatibility with hydrofluorocarbon coolants, resistance to corrosion and blockage of expansion valves or capillary parts of the refrigerator, particularly preferable are those which have relatively low molecular weights and contain no sulfur, such as 2,6-di-t-butyl-p-cresol, 2,6-di-t-butyl-4-ethyl-phenol, 2,6-di-t-butyl-phenol, 2,4-dimethyl-6-t-butyl-phenol and butylhydroxyanisole.

In the mixture of polyoxyalkylene glycol and its alkyl ether with a phenol-type antioxidant, the mixing ratio of the phenol-type antioxidant is 0.01 to 5 parts by weight based on 100 parts by weight of the total weight of the polyoxyalkylene glycol and its modified material, and if the mixing ratio of the antioxidant is less than the range, oxidation stability of the mixture becomes lowered and if the mixing ratio is greater than the range, not only can the oxidation stability not be improved but also the lubricating properties are impaired. Further it sometimes causes blocking of expansion valves or capillary parts of a refrigerator. Even though the content of the antioxidant is within the range, a decrease in the mixing ratio makes the oxidation stability of the mixture lower, whereas an increase in the content makes its lubricating property worse, and accordingly, the mixing ratio of the phenol-type antioxidant is preferably 0.05 to 3 parts by weight and more preferably 0.05 to 1 parts by weight based on 100 parts by weight of the total weight of polyoxyalkylene glycol and its modified material.

The lubricant for use in refrigerators according to the present invention may be used alone or, if necessary, in combination with other known additives for the purpose of further improving its lubricating properties and stability. For example, a phosphorous-type additive may be incorporated with the lubricant as an extreme pressure agent or a friction-controlling agent, such as an aryl group- and/or alkyl group-containing phosphate and/or phosphite.

Typical example of such phosphorous-type additives include normal phosphates such as trimethyl phosphate, triethyl phosphate, tributyl phosphate, tri-2-ethylhexyl phosphate, tributoxyethyl phosphate, trioleyl phosphate, triphenyl phosphate, tricresyl phosphate, trixylenyl phosphate, cresyl diphenyl phosphate, xylenyl diphenyl phosphate, 2-ethylhexyldiphenyl phosphate and the like; acidic phosphates such as methyl acid phosphate, ethyl acid phosphate, isopropyl acid phosphate, butyl acid phosphate, 2-ethylhexyl acid phosphate, isodecyl acid phosphate, lauryl acid phosphate, isotridecyl acid phosphate, myristyl acid phosphate, isostearyl acid phosphate, oleyl acid phosphate and the like; tertiary phosphites such as triphenyl phosphite, tri(p-cresyl) phosphite, tris(nonylphenyl) phosphite, triisooctyl phosphite, diphenyisodecyl phosphite, phenyldiisodecyl phosphite, triisodecyl phosphite, tristearyl phosphite, trioleyl phosphite and the like; and secondary phosphites such as di-2-ethylhexyl hydrogen phosphite, dilauryl hydrogen phosphite, dioleyl hydrogen phosphite and the like.

Among these, acidic phosphates are limited in application because of their corrosiveness, and their compatibility decreases as the carbon atoms in the alkyl group increases and accordingly, preferably used are, for example, normal phosphates having aryl or alkyl-aryl groups such as tricresyl phosphate and tertiary phosphites such as triphenyl phosphite.

Although it is generally thought that the phosphorous-type additives described above reduce the stability of refrigerator oil when added thereto, the lubricant for use in refrigerators according to the present invention has excellent stability, and therefore there is nothing preventing them from being added to refrigerator oils. Particularly, in the lubricant for use in refrigerators of the present invention in which polyoxyalkylene glycol and its alkyl ether are used, the use of the phosphorous-type additives described is preferable, since the lubricating properties of the lubricants are remarkably improved by combining them with the phosphorous-type additives. In this case, the mixing ratio of the phosphorous-type additive is preferably 0.1 to 10 parts by weight based on 100 parts by weight of the lubricants for use in refrigerators of the present invention.

The lubricants for use in refrigerators according to the present invention can be incorporated with other additives such as zinc compounds, molybdenum compounds and the like as an extreme pressure agent or friction-controlling agent in the addition range ordinary employed, may be incorporated with other stabilizers such as glycidyl ether compounds and alicyclic epoxy compounds, and further may be incorporated with other antioxidants such as amine-type antioxidants (e.g. α-naphthylbenzylamine, phenothiazine, etc.). sulfer-type antioxidants and phosphorous-type antioxidants within the addition range commonly employed.

Furthermore, if desired, the lubricants for use in refrigerators of the present invention may be mixed with other known refrigerator oils such as synthetic oils (e.g. alkylbenzene, poly-α-olefin, etc.) and highly purified naphthene-type mineral oils which have a good low temperature fluidity and barely separate out waxes, so far as the addition of such oils does not impair the effect of the present invention. Even though increasing the blending ratio of the other refrigerator oils above improves the volume resistivity of the lubricants for use in refrigerators of the present invention, the compatibility of the lubricants with hydrofluorocarbon coolants tends to decrease. Therefore, the blending ratio of the lubricants for use in refrigerators of the present invention with other refrigerator oils is preferably 1:0 to 1:5, and more preferably 1:0 to 1:2.

Further, if the synthetic oil used in the present invention is polyoxyalkylene glycol, it is preferable that the alkylene groups in the polyoxyalkylene glycol are isopropylene groups and/or isobutylene groups in view of compatibility with alkylbenzene, poly-α-olefin or refined naphthenie-type mineral oils.

The refrigerant composition used for refrigerators of the present invention contains the lubricants of the content described above and hydrofluorocarbon coolants and the blending ratio of both components is not particularly limited, as long as it is within the range of 1:99 to 99:1 by weight.

The hydrofluorocarbon coolants used in the present refrigerant composition are also not particularly limited, but one or mixtures of two or more selected from the group consisting of R 134a, R 32 and R 125 may be employed.

EMBODIMENTS

The present invention will now be explained and exemplified in detail in the following Examples, although the invention is not to be limited thereby. Further, the following Examples will use additives for refrigerators of Samples 1~5, 18, 19 and 35, and ester linkages having compounds of Samples 6~17 and polyoxyalkylene glycol of Samples 20~34 as base oils in the Examples described hereinafter.

Sample 1

Diisopropylcarbodiimide represented by the following formula:

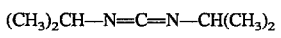

$$(CH_3)_2CH—N=C=N—CH(CH_3)_2$$

Sample 2

Bis(diisopropylphenyl)carbodiimide represented by the following formula:

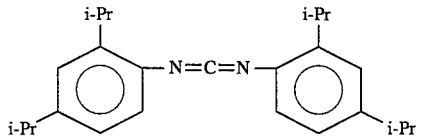

wherein i-Pr represents the following group:

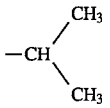

And i-Pr described hereinafter has the same meaning.

Sample 3

Carbodiimide compound represented by the following formula:

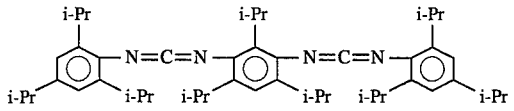

Sample 4

Cycloaliphate epoxy compound represented by the following formula:

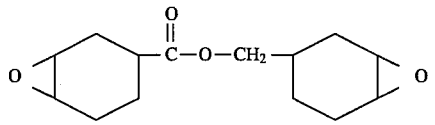

Sample 5

Phenylglycidylether represented by the following formula:

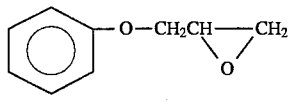

Sample 6

Esters of mixed 2-ethylhexanoic, 2-methylhexanoic and 2-ethylpentanoic acids (molar ratio of 2:1.5:6.5) with penterythritol [Kinematic viscosity of 5.3 cSt at 100° C., acid value of 0.008 mgKOH/g and (Y−4)×(X+3)/Y=1.8].

Sample 7

Esters of mixed 2-ethylbutanoic and n-hexanoic acids (molar ratio of 1:1) with dipentaerythritol [Kinematic viscosity of 10.8 cSt at 100° C., acid value of 0.005 mgKOH/g and (Y−4)×(X+3)/Y=1.8].

Sample 8

Ester of n-heptanoic acid with trimethylolpropane [Kinematic viscosity of 3.4 cSt at 100° C. acid value of 0.004 mgKOH/g and (Y−4)×(X+3)/Y=2.6].

Sample 9

Ester of 3,5,5-trimethylhexanoic acid with neopentylglycol [Kinematic viscosity of 3.1 cSt at 100° C., acid value of 0.010 mgKOH/g and (Y−4)×(X+3)/Y=1.7].

Sample 10

Polyoxypropyleneglycol diacetate (Kinematic viscosity of 9.8 cSt at 100° C. and acid value of 0.009 mgKOH/g).

Sample 11

Ester of n-hexanoic acid with pentaerythritol [Kinematic viscosity of 4.2 cSt at 100° C., acid value of 0.006 mgKOH/g and (Y−4)×(X+3)=2.3].

Sample 12

Ester of mixed 2-methylhexanoic and 2-ethylpentanoic acids (molar ratio of 1.5:6.5) with trimethylolpropane [Kinematic viscosity of 3.3 cSt at 100° C., acid value of 0.008 mgKOH/g and (Y−4)×(X+3)/Y=1.4].

Sample 13

A mixture of Samples 6 and 12 [Weight ratio of 7:3, kinematic viscosity of 4.6 cSt at 100° C., acid value of 0.008 mgKOH/g and (Y−4)×(X+3)/Y=1.7].

Sample 14

Ester of 2-ethylhexanoic acid with pentaerythritol [Kinematic viscosity of 6.3 cSt at 100° C., acid value of 0.009 mgKOH/g and (Y−4)×(X+3)/Y=2.3].

Sample 15

Ester of 2-ethylhexanoic acid with neopentylglycol [Kinematic viscosity of 2.1 cSt at 100° C., acid value of 0.002 mgKOH/g and (Y−4)×(X+3)/Y=1.7].

Sample 16

A mixture of Samples 14 and 15 [Weight ratio of 85:15, kinematic viscosity of 5.0 cSt, acid value of 0.006 mgKOH/g and (Y−4)×(X+3)/Y=2.2]

Sample 17

Esters of mixed 2-ethylhexanoic and n-nonanoic acids (molar ratio of 1:1) with pentaerythritol [Kinematic viscosity of 6.3 cSt at 100° C., acid value of 0.004 mgKOH/g and (Y−4)×(X+3)/Y=3.3].

Sample 18

2,6-di-t-butyl-p-cresol.

Sample 19

3-tris(2-metyl-4-hydroxy-5-t-butylphenyl)butane.

Sample 20

Polyoxypropyleneglycoldimethylether represented by the following formula:

$$CH_3O(CH_2\underset{\underset{CH_3}{|}}{C}HO)_{10}CH_3$$

(Kinematic viscosity of 5.1 cSt at 100° C. and acid value of 0.03 mgKOH/g)

Sample 21

Polyoxypropyleneglycoldimethylether represented by the following formula:

$$CH_3O(CH_2\underset{\underset{CH_3}{|}}{C}HO)_{32}CH_3$$

(Kinematic viscosity of 18.0 cSt at 100° C. and acid value of 0.07 mgKOH/g)

Sample 22

Polyoxypropyleneglycoldimethylether represented by the following formula:

$$CH_3O(CH_2\underset{\underset{CH_3}{|}}{C}HO)_{23}CH_2CH_3$$

(Kinematic viscosity of 12.0 cSt at 100° C. and acid value of 0.03 mgKOH/g)

Sample 23

Polyoxypropyleneglycolmonomethylether represented by the following formula:

$$CH_3O(CH_2\underset{\underset{CH_3}{|}}{C}HO)_{16}H$$

(Kinematic viscosity of 9.3 cSt at 100° C. and acid value of 0.01 mgKOH/g)

Sample 24

Polyoxyethylenepolyoxypropyleneglycolmonomethylether (block linkage) represented by the following formula:

$$CH_3O(CH_2\underset{\underset{CH_3}{|}}{C}HO)_{14}(CH_2CH_2O)_5H$$

(Kinematic viscosity of 13.2 cSt at 100° C. and acid value of 0.01 mgKOH/g)

Sample 25

Polyoxypropyleneglycolmonopropylether represented by the following formula:

$$CH_3CH_2CH_2O(CH_2\underset{\underset{CH_3}{|}}{C}HO)_{16}H$$

(Kinematic viscosity of 9.7 cSt at 100° C. and acid value of 0.03 mgKOH/g)

Sample 26

Polyoxyethylenepolyoxypropyleneglycoldimetylether (random linkage) represented by the following formula:

$$CH_3O(CH_2\underset{\underset{CH_3}{|}}{C}HO)_{26}(CH_2CH_2O)_8CH_3$$

(Kinematic viscosity of 18.3 cSt at 100° C. and acid value of 0.04 mgKOH/g)

Sample 27

Polyoxyethylenepolyoxypropyleneglycoldimethyether (block linkage) represented by the following formula:

$$CH_3O(CH_2\underset{\underset{CH_3}{|}}{C}HO)_{14}(CH_2CH_2O)_5CH_3$$

(Kinematic viscosity of 10.6 cSt at 100° C. and acid value of 0.01 mgKOH/g)

Sample 28

Polyoxyethylenepolyoxypropyleneglycoldimethylether (random-block linkage) represented by the following formula:

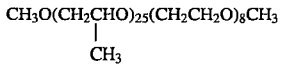

(Kinematic viscosity of 18.9 cSt at 100° C. and acid value of 0.10 mgKOH/g)

Sample 29

Polyoxyehylenepolyoxypropyleneglycol (random linkage) represented by the following formula:

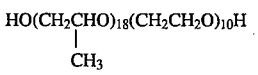

(Kinematic viscosity of 17.4 cSt at 100° C. and acid value of 0.02 mgKOH/g)

Sample 30

Polyoxypropyleneglycerylether trimethylether represented by the following formula:

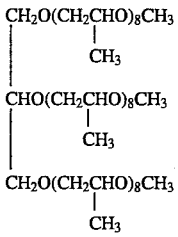

(Kinematic viscosity of 12.3 cSt at 100° C. and acid value of 0.03 mgKOH/g)

Sample 31

Polyoxypropyleneglycerylether represented by the following formula:

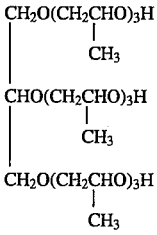

Sample 32

Polyoxyethylenepolyoxypropyleneglycoldimethylether (random linkage) represented by the following formula:

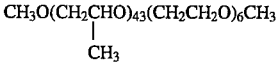

(Kinematic viscosity of 26.3 cSt at 100° C. and acid value of 0.02 mgKOH/g)

Sample 33

A mixture of Samples 21 and 23 (Blending weight ratio of 1:1, kinematic viscosity of 12.5 cSt at 100° C. and acid value of 0.03 mgKOH/g)

Sample 34

A mixture of Samples 24 and 26 (Blending weight ratio of 1:1, kinematic viscosity of 14.7 cSt at 100° C. and acid value of 0.02 mgKOH/g)

Sample 35

Tricresylphosphate

Sample 36

Polyoxybutylenepolyoxypropyleneglycoldimethylether (block linkage) represented by the following formula:

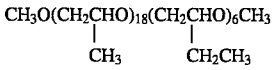

(Kinematic viscosity of 12.0 cSt at 100° C. and acid value of 0.04 mgKOH/g)

The present products and comparative products were prepared by using the above lubricants and base oils before carrying out the Examples. For these products, compatibility with hydrofluorocarbon coolants were tested as follows and the results obtained are indicated in the following Tables 1-1 to 1-4.

Tests of compatibility with hydrofluorocarbon coolants:

15 parts by weight of each Sample described in Table 1 and 85 parts by weight of ① R 134a, ② a mixture of R 134a and R 32 (molar ratio of 1:1) or ③ a mixture of R 134a, R 32 and R 125 (molar ratio of 52:23:25) were charged for the purpose of examining compatibility in a temperature range of −20° to 50° C.

TABLE 1-1

| | Base oil Sample No. | Sample No. of additive | Amount of additive added (%) | Compatibility with ① | Compatibility with ② |
|---|---|---|---|---|---|
| Inventive product | | | | | |
| 1 | 6 | 2 | 2 | Completely dissolved | |
| 2 | 7 | 1 | 2 | Completely dissolved | |
| 3 | 8 | 1 | 2 | Completely dissolved | |
| 4 | 9 | 2 | 2 | Completely dissolved | |
| 5 | 10 | 1 | 2 | Completely dissolved | |
| 6 | 6 | 1 | 2 | Completely dissolved | |
| 7 | 6 | 3 | 2 | Completely dissolved | |
| 8 | 6 | 2 | 1 | Completely dissolved | |
| 9 | 6 | 2 | 5 | Completely dissolved | |
| 10 | 11 | 1 | 2 | Completely dissolved | |
| 11 | 12 | 2 | 2 | Completely dissolved | |
| 12 | 13 | 2 | 2 | Completely dissolved | |
| Comparative product | | | | | |
| 1 | 6 | | | Completely dissolved | |
| 2 | 7 | | | Completely dissolved | |
| 3 | 8 | | | Completely dissolved | |

TABLE 1-1-continued

| | Base oil Sample No. | Sample No. of additive | Amount of additive added (%) | Compatibility with ① | Compatibility with ② |
|---|---|---|---|---|---|
| 4 | 9 | | | Completely dissolved | |
| 5 | 11 | | | Completely dissolved | |
| 6 | 6 | 4 | 2 | Completely dissolved | |
| 7 | 6 | 5 | 2 | Completely dissolved | |

TABLE 1-2

| | Base oil Sample No. | Sample No. of additive | Amount of additive added (%) | Compatibility with ① | Compatibility with ③ |
|---|---|---|---|---|---|
| Inventive product | | | | | |
| 13 | 14 | 2 | 2 | ≧−10° C. | ≧−5° C. |
| 14 | 15 | 2 | 2 | Completely dissolved | |
| 15 | 16 | 2 | 2 | Completely dissolved | |
| 16 | 17 | 2 | 2 | ≧+10° C. | ≧+20° C. |
| 17 | 6 | 2, 18 | 1, 0.1 | Completely dissolved | |
| 18 | 6 | 2, 19, 35 | 1, 0.1, 2 | Completely dissolved | |
| Comparative product | | | | | |
| 8 | 14 | | | ≧−10° C. | ≧−5° C. |
| 9 | 15 | | | Completely dissolved | |
| 10 | 16 | | | Completely dissolved | |
| 11 | 17 | | | ≧+8° C. | +20° C. |
| 12 | 6 | 4, 18 | 2, 0.1 | Completely dissolved | |
| 13 | 6 | 19, 35 | 0.1, 2 | Completely dissolved | |

NOTE: The term ≧−10° C. means 'dissolved at a temperature of not less than −10°C.'.
The term ≧−5° C. means 'dissolved at a temperature of not less than −5° C.'.
The term ≧+8° C. means 'dissolved at a temperature of not less than +8° C.'.
The term ≧+10° C. means 'dissolved at a temperature of not less than +10° C.'.
The term ≧+20° C. means 'dissolved at a temperature of not less than +20° C.'.

TABLE 1-3

| | Base oil Sample No. | Sample No. of additive | Amount of additive added (%) | Compatibility with ① | Compatibility with ② |
|---|---|---|---|---|---|
| Inventive product | | | | | |
| 19 | 20 | 3, 18 | 2, 0.1 | CD | CD |
| 20 | 21 | 1, 19, 35 | 2, 0.1. 4 | CD | ≦+41° C. dissolved |
| 21 | 22 | 2, 18, 19 | 2, 0.05, 0.05 | CD | CD |
| 22 | 23 | 2, 19 | 1, 0.1 | CD | CD |
| 23 | 24 | 2, 18, 35 | 1, 0.1, 4 | CD | CD |
| 24 | 25 | 2, 18 | 1. 0.1 | CD | CD |
| 25 | 26 | 2, 19 | 1, 0.1 | CD | ≦+40° C. dissolved |
| 26 | 27 | 2, 18 | 1, 0.05 | CD | CD |
| 27 | 28 | 2, 18 | 1, 0.1 | CD | ≦+35° C. dissolved |
| 28 | 28 | 2, 18 | 1, 0.5 | CD | ≦+35° C. dissolved |
| 29 | 28 | 2, 18, 35 | 2, 0.1, 2 | CD | ≦+30° C. dissolved |
| 30 | 28 | 2, 18, 35 | 0.5, 0.1, 2 | CD | ≦+41° C. dissolved |
| 31 | 29 | 2, 19 | 2, 0.1 | CD | −15~+45° C. dissolved |
| 32 | 30 | 2, 18 | 0.5, 0.05 | CD | CD |
| 33 | 31 | 2, 19 | 2, 0.5 | CD | CD |
| 34 | 32 | 2, 18 | 1, 0.1 | ≦+15° C. dissolved | ≦+2° C. dissolved |
| 35 | 33 | 2, 19 | 1, 0.1 | CD | CD |

TABLE 1-3-continued

| | Base oil Sample No. | Sample No. of additive | Amount of additive added (%) | Compatibility with ① | Compatibility with ② |
|---|---|---|---|---|---|
| 36 | 34 | 2, 18 | 1, 0.1 | CD | CD |
| 37 | 36 | 2, 18 | 1, 0.1 | CD | CD |

NOTE: The term CD means 'Completely Dissolved'.

TABLE 1-4

| | Base oil Sample No. | Sample No. of additive | Amount of additive added (%) | Compatibility with ① | Compatibility with ② |
|---|---|---|---|---|---|
| Comparative Example | | | | | |
| 14 | 20 | 4, 18 | 2, 0.1 | CD | CD |
| 15 | 21 | 5, 19, 35 | 2, 0.1, 4 | CD | ≦+41° C. dissolved |
| 16 | 22 | 4, 18, 19 | 2, 0.05, 0.05 | CD | CD |
| 17 | 23 | 5, 19 | 1, 0.1 | CD | CD |
| 18 | 24 | 4, 18, 35 | 1, 0.1, 4 | CD | CD |
| 19 | 25 | 4, 18 | 1, 0.1 | CD | CD |
| 20 | 26 | 5, 19 | 1, 0.1 | CD | ≦+47° C. dissolved |
| 21 | 27 | 4, 18 | 1, 0.05 | CD | CD |
| 22 | 28 | 5, 18, 35 | 2, 0.1, 2 | CD | ≦+37° C. dissolved |
| 23 | 29 | 4, 19 | 2, 0.1 | CD | −15~+45° C. dissolved |
| 24 | 30 | 5, 18 | 0.5, 0.05 | CD | CD |
| 25 | 31 | 4, 19 | 2, 0.5 | CD | CD |
| 26 | 32 | 5, 18 | 1, 0.1 | ≦+18° C. dissolved | ≦+5° C. dissolved |
| 27 | 33 | 5, 19 | 1, 0.1 | CD | CD |
| 28 | 34 | 5, 18 | 1, 0.1 | CD | CD |
| 29 | 36 | 5, 18 | 1, 0.1 | CD | CD |

NOTE: The term CD means 'Completely Dissolved'.

As shown in Table 1-1 to 1-4 above, the products of the present invention, except for a portion thereof, are extremely superior in compatibility with hydrofluorocarbons under the conditions employed in this test. Although a portion of them may not be termed extremely superior in compatibility with hydrofluorocarbons under the conditions employed in this test, they are fully compatible with hydrofluorocarbons at least within a certain temperature range. Therefore they are practical for use as refrigerator oils if they are adequately selected depending on intended use, type of refrigerator and type of compressor employed.

Example and Comparative Example

For the inventive products and comparative products described in Table 1, acid value inhibiting and stabilizing tests were conducted. These processes indicated the following:

I. Acid value inhibiting test:

After the organic acids described in Table 2 were added to the inventive products and comparative products described in Table 1-1 to adjust to the acid value indicated in Table 2, 200 gr of each sample was charged in a 300 ml glass beaker, heated to 60° C. with stirring, and the acid value of samples that were collected at varying times was determined. Results obtained are indicated in Table 2.

TABLE 2

| | Sample No. | Organic acid | Acid value (mgKOH/g) | Change of acid value (mgKOH/g) 1 hr later | 2 hrs later | 4 hrs later |
|---|---|---|---|---|---|---|
| Inventive product | 1 | isoheptanoic acid | 1.54 | 0.09 | 0.07 | 0.06 |
| | 2 | n-hexanoic acid | 1.52 | 0.11 | 0.10 | 0.04 |
| | 3 | n-heptanoic acid | 1.60 | 0.12 | 0.08 | 0.07 |
| | 4 | isononanoic acid | 1.58 | 0.08 | 0.08 | 0.06 |
| | 5 | acetic acid | 1.51 | 0.18 | 0.12 | 0.10 |
| | 6 | isoheptanoic acid | 1.50 | 0.06 | 0.06 | 0.05 |
| | 7 | isoheptanoic acid | 1.58 | 0.15 | 0.12 | 0.10 |
| | 8 | isoheptanoic acid | 1.56 | 0.54 | 0.35 | 0.21 |
| | 9 | isoheptanoic acid | 1.51 | 0.08 | 0.08 | 0.07 |
| | 10 | n-hexanoic acid | 1.51 | 0.13 | 0.09 | 0.04 |
| | 11 | isoheptanoic acid | 1.53 | 0.12 | 0.09 | 0.06 |
| | 12 | isoheptanoic acid | 1.57 | 0.10 | 0.08 | 0.05 |
| Comparative product | 1 | isoheptanoic acid | 1.51 | 1.53 | 1.52 | 1.54 |
| | 2 | n-hexanoic acid | 1.58 | 1.54 | 1.60 | 1.61 |
| | 3 | n-heptanoic acid | 1.62 | 1.65 | 1.60 | 1.62 |
| | 4 | isononanoic acid | 1.40 | 1.40 | 1.43 | 1.41 |
| | 5 | acetic acid | 1.51 | 1.47 | 1.50 | 1.49 |
| | 6 | isoheptanoic acid | 1.58 | 1.14 | 0.75 | 0.30 |
| | 7 | isoheptanoic acid | 1.51 | 1.48 | 1.20 | 1.14 |

II. Stability test:

To each of the products of the present invention and the comparative products shown in Table 1-1 and 1-2, 1000 ppm of water was added respectively, and then 20 parts by weight of the resulting mixture was charged into a 100 ml stainless steel autoclave (SUS-316). Into this, three pieces of steel, copper and aluminum (each 50×25×1.5 mm) were inserted.

The autoclave was then deaerated at room temperature for five minutes at 3 mmHg or below, to completely remove air in the autoclave and any air dissolved in the oil. The autoclave was then charged with 80 parts by weight of R 134a while the autoclave was cooled to −50° C. After sealing, the autoclave was heated at 175° C. for 14 days (i.e. 336 hours). After completion of the heating, the autoclave was deaerated at 60° C. under vacuum to remove R 134a and any water content.

The resultant oil was measured for kinematic viscosity, acid value and metal content. For the products 1* and 2* of the present invention shown in Table 3-1, the stability test was carried out using a mixture of R 134a and R 32 (1:1) instead of R 134a alone. For the products 1, 2 and 16 of the present invention shown in Table 3-2, the stability test was carried out using a mixture of R 134a, R32 and R 125 (52:23:25) instead of R 134a alone. The results are summarized in Tables 3-1 and 3-2.

TABLE 3-1

| | Kinematic Viscosity at 100° C. (cSt) | | Change of Viscosity | Acid Value (mgKOH/g) | | Metal Content (ppm) | | |
|---|---|---|---|---|---|---|---|---|
| | Before Test | After Test | (%) | Before Test | After Test | Fe | Cu | Al |
| Inventive Product | | | | | | | | |
| 1 | 5.4 | 5.4 | 0 | 0.008 | 0.008 | ND | ND | ND |
| 2 | 11.0 | 11.0 | 0 | 0.005 | 0.006 | ND | ND | ND |
| 3 | 3.5 | 3.5 | 0 | 0.004 | 0.005 | ND | ND | ND |
| 4 | 3.1 | 3.1 | 0 | 0.010 | 0.010 | ND | ND | ND |
| 5 | 9.8 | 9.8 | 0 | 0.009 | 0.009 | ND | ND | ND |
| 6 | 5.2 | 5.2 | 0 | 0.008 | 0.008 | ND | ND | ND |
| 7 | 5.4 | 5.4 | 0 | 0.008 | 0.008 | ND | ND | ND |
| 8 | 5.4 | 5.4 | 0 | 0.008 | 0.010 | ND | ND | ND |
| 9 | 5.5 | 5.5 | 0 | 0.008 | 0.008 | ND | ND | ND |
| 10 | 4.1 | 4.1 | 0 | 0.006 | 0.006 | ND | ND | ND |
| 11 | 3.3 | 3.3 | 0 | 0.008 | 0.008 | ND | ND | ND |
| 12 | 4.7 | 4.7 | 0 | 0.008 | 0.008 | ND | ND | ND |
| 1* | 5.4 | 5.4 | 0 | 0.008 | 0.008 | ND | ND | ND |
| 2* | 11.0 | 11.0 | 0 | 0.005 | 0.005 | ND | ND | ND |
| Comp. Example | | | | | | | | |
| 1 | 5.4 | 5.6 | +0.4 | 0.008 | 0.254 | 2.5 | 3.2 | ND |
| 6 | 5.2 | 5.2 | 0 | 0.008 | 0.035 | 3.4 | ND | ND |
| 7 | 5.3 | 5.3 | 0 | 0.008 | 0.067 | 10.5 | 2.1 | 1.2 |

TABLE 3-2

| | Kinematic Viscosity at 100° C. (cSt) | | Change of Viscosity | Acid Value (mgKOH/g) | | Metal Content (ppm) | | |
|---|---|---|---|---|---|---|---|---|
| | Before Test | After Test | (%) | Before Test | After Test | Fe | Cu | Al |
| Inventive Product | | | | | | | | |
| 13 | 6.3 | 6.3 | 0 | 0.009 | 0.003 | ND | ND | ND |
| 14 | 2.2 | 2.2 | 0 | 0.002 | 0.006 | ND | ND | ND |
| 15 | 5.1 | 5.1 | 0 | 0.006 | 0.009 | ND | ND | ND |
| 16 | 6.3 | 6.3 | 0 | 0.004 | 0.004 | ND | ND | ND |
| 17 | 5.3 | 5.3 | 0 | 0.008 | 0.006 | ND | ND | ND |
| 18 | 5.3 | 5.3 | 0 | 0.008 | 0.006 | ND | ND | ND |
| 1* | 5.4 | 5.3 | 0 | 0.008 | 0.007 | ND | ND | ND |
| 2* | 11.0 | 11.0 | 0 | 0.005 | 0.004 | ND | ND | ND |

TABLE 3-2-continued

| | Kinematic Viscosity at 100° C. (cSt) | | Change of Viscosity | Acid Value (mgKOH/g) | | Metal Content (ppm) | | |
|---|---|---|---|---|---|---|---|---|
| | Before Test | After Test | (%) | Before Test | After Test | Fe | Cu | Al |
| 16* Comp. Product | 6.3 | 6.3 | 0 | 0.004 | 0.005 | ND | ND | ND |
| 8 | 6.3 | 6.3 | 0 | 0.009 | 0.028 | ND | ND | ND |
| 9 | 2.2 | 2.2 | 0 | 0.002 | 0.025 | ND | ND | ND |
| 10 | 5.1 | 5.1 | 0 | 0.006 | 0.031 | ND | ND | ND |
| 11 | 6.3 | 6.3 | 0 | 0.004 | 0.054 | 4.1 | 2.6 | ND |
| 12 | 5.3 | 5.3 | 0 | 0.008 | 0.032 | ND | ND | ND |
| 13 | 5.3 | 5.3 | 0 | 0.008 | 0.091 | 15.3 | 6.4 | 7.2 |

In Table 3, (*) indicates that the stability tests were conducted by using the mixture of R 134a, R 32 and R 125. Further, the term ND means 'not detected'.

As shown in Table 3, it is clear that the lubricants according to the present invention are stable.

III. Stability test (2):

The resultant oil was measured for kinematic viscosity, acid value and metal content. For the products 1* and 17* of the present invention shown in Table 4, the stability test was carried out using a mixture of R 134a, R 32 and R 125 (52:23:52) instead of R 134a alone. The results are summarized in Table 4.

TABLE 4

| | Kinematic Viscosity at 100° C. (cSt) | | Change of Viscosity | Acid Value (mgKOH/g) | | Metal Content (ppm) | | |
|---|---|---|---|---|---|---|---|---|
| | Before Test | After Test | (%) | Before Test | After Test | Fe | Cu | Al |
| Inventive Product | | | | | | | | |
| 1 | 5.4 | 5.4 | 0 | 0.008 | 0.004 | ND | ND | ND |
| 6 | 9.8 | 9.8 | 0 | 0.008 | 0.002 | ND | ND | ND |
| 7 | 5.2 | 5.2 | 0 | 0.008 | 0.005 | ND | ND | ND |
| 8 | 5.4 | 5.4 | 0 | 0.008 | 0.015 | ND | ND | ND |
| 12 | 4.7 | 4.7 | 0 | 0.008 | 0.004 | ND | ND | ND |
| 13 | 6.3 | 6.3 | 0 | 0.009 | 0.005 | ND | ND | ND |
| 15 | 5.1 | 5.1 | 0 | 0.006 | 0.004 | ND | ND | ND |
| 17 | 5.3 | 5.3 | 0 | 0.008 | 0.006 | ND | ND | ND |
| 18 | 6.3 | 6.3 | 0 | 0.004 | 0.007 | ND | ND | ND |
| 1* | 5.4 | 5.4 | 0 | 0.008 | 0.006 | ND | ND | ND |
| 17* | 5.3 | 5.3 | 0 | 0.008 | 0.005 | ND | ND | ND |
| Comp. Product | | | | | | | | |
| 1 | 5.4 | 5.4 | 0 | 0.008 | 0.257 | ND | ND | ND |
| 5 | 4.2 | 4.5 | +7 | 0.006 | 1.97 | ND | ND | ND |
| 6 | 5.2 | 5.2 | 0 | 0.008 | 0.435 | 5.4 | ND | ND |
| 7 | 5.3 | 5.3 | 0 | 0.008 | 0.382 | 28.9 | 16.8 | 2.1 |
| 12 | 5.3 | 5.5 | +4 | 0.008 | 0.345 | ND | ND | ND |
| 13 | 5.3 | 5.7 | +8 | 0.008 | 0.866 | 35.3 | 24.4 | 9.0 |

To each of the products of the present invention and the comparative products shown in Table 1-1 and 1-2, 1000 ppm of water was added respectively and then 20 parts by weight of the resulting mixture was charged into a 100 ml stainless steel autoclave (SUS-316). Into this, three pieces of steel, copper and aluminum (each 50×25×1.5 mm) were inserted. The autoclave was then deaerated at room temperature for five minutes at 3 mmHg or below, to completely remove air in the autoclave and any air dissolved in the oil. The autoclave was then charged with 80 parts by weight of R 134a while the autoclave was cooled to −50° C. After sealing, the autoclave was heated at 175° C. for 35 days (i.e. 840 hours). After completion of heating, the autoclave was deaerated at 60° C. under vacuum to remove R 134a and any water content.

In Table 4, (*) indicates that the stability tests were conducted by using the mixture of R 134a, R 32 and 125.

In the products 6 and 7 of the present invention, a slight separation of a brown liquid substance at the bottom of the test oil was observed after completion of the test. On the other hand, for the products other than products 6 and 7 of the present invention, compatibility of their degraded oils with R 134a was examined. Yellow crystals were resultingly observed in the degraded oil of the product 8 of the present invention. Further, white precipitates were slightly detected in the comparative products 6 and 12 after completion of the tests.

As is apparent from the results of the test, the products of the present invention are stable. Among these, the compound of Sample 2, which is one of carbodiimide compounds, is found to be most suitable as a lubricant for use in refrigerators.

Stability test (3):

For each test, 75 parts by weight of each of the products of the present invention and comparative products were charged into a 200 ml stainless steel autoclave (SUS-316). The autoclave was further charged for each test with 25 parts by weight of R 134a while pressure was applied under cooling to −50° C. without removing air therefrom. After sealing, the autoclave was heated at 80° C. The product in the autoclave was sampled after 50 days ① or after 150 days ②. These samples were deaerated at room temperature under reduced pressure to remove R 134a, and then their acid value was determined.

For the comparative products, evaluation of acid value was further carried out using the degraded oil obtained 150 days after the test in the following manner. To 74 parts by weight of the degraded oil, 1 part by weight of Sample 2 ③ or Sample 4 ④ was added. The resulting mixture was charged into a 200 ml stainless steel autoclave (SUS-316), and 25 parts by weight of R 134a was further charged thereinto under cooling to −50° C. with pressure and without removing the air therefrom. After sealing, the autoclave was heated at 80° C. for 16 hours. After completion of the test, the resultant product was taken out and deaerated at room temperature under vacuum to remove R 134a, then subjected to the determination of acid value. The results are shown in Tables 5 and 6.

TABLE 5

| | Acid Value Before Test (mgKOH/g) | Acid Value (mgKOH/g) ① After 50 days | ② After 150 days |
|---|---|---|---|
| Inventive Product | | | |
| 19 | 0.03 | 0.02 | 0.03 |
| 20 | 0.07 | 0.02 | 0.09 |
| 21 | 0.03 | 0.03 | 0.02 |
| 22 | 0.01 | 0.02 | 0.04 |
| 23 | 0.01 | 0.03 | 0.10 |
| 24 | 0.03 | 0.03 | 0.05 |
| 25 | 0.04 | 0.06 | 0.07 |
| 26 | 0.01 | 0.04 | 0.03 |
| 27 | 0.10 | 0.06 | 0.04 |
| 28 | 0.10 | 0.03 | 0.09 |
| 29 | 0.10 | 0.08 | 0.10 |
| 30 | 0.10 | 0.06 | 0.11 |
| 31 | 0.02 | 0.04 | 0.02 |
| 32 | 0.03 | 0.01 | 0.01 |
| 33 | 0.03 | 0.01 | 0.02 |
| 34 | 0.02 | 0.01 | 0.02 |
| 35 | 0.03 | 0.03 | 0.04 |
| 36 | 0.02 | 0.02 | 0.05 |
| 37 | 0.04 | 0.02 | 0.02 |

TABLE 6

| | Acid Value Before Test (mgKOH/g) | Acid Value (mgKOH/g) ① After 50 days | ② After 150 days | Acid Value (*) (mgKOH/g) Sample 2 | Sample 4 |
|---|---|---|---|---|---|
| Comp. Product | | | | | |
| 14 | 0.03 | 0.05 | 0.52 | 0.06 | 0.37 |
| 15 | 0.07 | 0.15 | 0.82 | 0.05 | 0.07 |
| 16 | 0.03 | 0.03 | 0.38 | 0.06 | 0.38 |
| 17 | 0.01 | 0.04 | 0.41 | 0.02 | 0.40 |
| 18 | 0.01 | 0.22 | 0.91 | 0.08 | 0.81 |
| 19 | 0.03 | 0.03 | 0.36 | 0.02 | 0.35 |
| 20 | 0.04 | 0.06 | 0.43 | 0.03 | 0.39 |
| 21 | 0.01 | 0.01 | 0.53 | 0.03 | 0.49 |
| 22 | 0.10 | 0.16 | 0.76 | 0.09 | 0.75 |
| 23 | 0.02 | 0.02 | 0.41 | 0.01 | 0.38 |
| 24 | 0.03 | 0.04 | 0.54 | 0.03 | 0.52 |
| 25 | 0.03 | 0.06 | 0.37 | 0.04 | 0.37 |
| 26 | 0.02 | 0.03 | 0.49 | 0.05 | 0.44 |
| 27 | 0.03 | 0.04 | 0.53 | 0.03 | 0.52 |
| 28 | 0.02 | 0.02 | 0.47 | 0.04 | 0.44 |
| 29 | 0.04 | 0.05 | 0.61 | 0.04 | 0.58 |

*Acid value after adding the additive to the degraded oil after 150 days.

As is apparent from Tables 5 and 6 above, the products of the present invention are highly stable. In addition, the carbodiimide compounds of the present invention have an effect of catching the acidic ingredients which are produced at the same time the degradation of polyoxyalkylene glycol and its alkyl ether occurs.

EFFECT OF INVENTION

The present invention has the following advantages:

The lubricants for use in refrigerators employing hydrofluorocarbon coolants have no trouble in evaporators, since said lubricants have good compatibility with hydrofluorocarbon coolants such as R 134a and the like.

Also, since these lubricants rapidly react with free acids, water and the like generated in refrigerators, hydrolytic stability is improved to prevent corrosion.

We claim:

1. A lubricated refrigerant comprising hydrofluorocarbon coolant, synthetic oil and at least one carbodiimide compound represented by the following formula:

$$R_1—N=C=N—R_2$$

wherein $R_1$ and $R_2$ each represent a moiety selected from the group consisting of a hydrogen atom, a hydrocarbyl group, a nitrogen containing hydrocarbyl group, and an oxygen containing hydrocarbyl group, and $R_1$ and $R_2$ may each be the same moiety.

2. The lubricated refrigerant of claim 1 wherein $R_1$ and $R_2$ each independently represent a group having the following general formula:

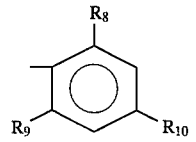

wherein $R_8$, $R_9$, and $R_{10}$ each independently represent a moiety selected from the group consisting of a hydrogen atom and an alkyl group having 1 through 10 carbon atoms and $R_1$ and $R_2$ may each be the same moiety.

3. The lubricated refrigerant of claim 2 wherein said synthetic oil contains at least one compound having an ester linkage.

4. The lubricated refrigerant of claim 2 which additionally contains said hydrofluorocarbon coolant at a weight ratio of said lubricant to said hydrofluorocarbon coolant of 1:99 to 99:1.

5. The lubricated refrigerant of claim 2 wherein said synthetic oil comprises antioxidant containing at least one phenolic hydroxyl group per molecule and polyether represented by the following general formula:

$$Z[O(AO)_mR_{11}]_p$$

wherein Z represents an alcohol residue having 1 to 8 hydroxyl groups, A represents an alkylene group having 1 to 4 carbon atoms, $R_{11}$ represents a hydrogen atom or alkyl group having 1 to 8 carbon atoms and which may be the same group or different group in each repeating unit, m and p may be satisfied within the ranges of $1 \leqq m \leqq 80$, $1 \leqq p \leqq 8$ and $1 \leqq (m \times p) \leqq 300$, there being from about 0.5 to about 5 parts by weight of said antioxidant for each 100 parts by weight of said polyether.

6. The lubricated refrigerant of claim 1 wherein said carbodiimide compound is represented by the following formula:

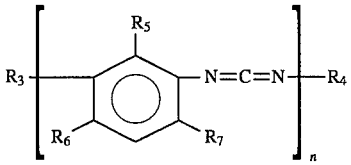

wherein $R_3$ represents a hydrogen atom or an alkyl group having 1 to 10 carbon atoms, $R_4$ represents a hydrogen atom, and alkyl group having 1 to 10 atoms or a substituent group represented by the following general formula:

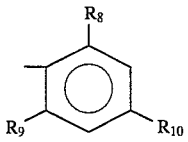

wherein $R_5$, $R_6$, $R_7$, $R_8$, $R_9$ and $R_{10}$ each independently represent a hydrogen atom or an alkyl group, the total number of carbon atoms contained in $R_5$, $R_6$, and $R_7$ is less than 10, the total number of carbon atoms contained in $R_8$, $R_9$, and $R_{10}$ is less than 10, and $n \geqq 2$.

7. The lubricated refrigerant of claim 6 wherein said synthetic oil contains at least one compound having an ester linkage.

8. The lubricated refrigerant of claim 6 which additionally contains said hydrofluorocarbon coolant at a weight ratio of said lubricant to said hydrofluorocarbon coolant of 1:99 to 99:1.

9. The lubricated refrigerant of claim 6 wherein said synthetic oil comprises antioxidant containing at least one phenolic hydroxyl group per molecule and polyether represented by the following general formula:

$$Z[O(AO)_mR_{11}]_p$$

wherein Z represents an alcohol residue having 1 to 8 hydroxyl groups, A represents an alkylene group having 1 to 4 carbon atoms, $R_{11}$ represents a hydrogen atom or alkyl group having 1 to 8 carbon atoms and which may be the same group or different group in each repeating unit, m and p may be satisfied within the ranges of $1 \leqq m \leqq 80$, $1 \leqq p \leqq 8$ and $1 \leqq (m \times p) \leqq 300$, there being from about 0.5 to about 5 parts by weight of said antioxidant for each 100 parts by weight of said polyether.

10. The lubricated refrigerant of claim 1 wherein said synthetic oil contains at least one compound having an ester linkage.

11. The lubricated refrigerant of claim 10 wherein said synthetic oil contains fatty acid esters having linear chains and/or branched chains of neopentyl polyol and one or more ester synthetic oils meeting the following formula:

$$0 \leqq (Y-4) \times (X+3)/Y \leqq 3.5$$

wherein X represents an average hydroxyl group number per neopentyl polyol molecule and Y represents an average carbon number of a linear part of saturated fatty acids having a linear and/or branched chain.

12. The lubricated refrigerant of claim 11 which additionally contains said hydrofluorocarbon coolant at a weight ratio of said lubricant to said hydrofluorocarbon coolant of 1:99 to 99:1.

13. The lubricated refrigerant of claim 10 which additionally contains said hydrofluorocarbon coolant at a weight ratio of said lubricant to said hydrofluorocarbon coolant of 1:99 to 99:1.

14. The lubricated refrigerant of claim 1 which additionally contains said hydrofluorocarbon coolant at a weight ratio of said lubricant to said hydrofluorocarbon coolant of 1:99 to 99:1.

15. The lubricated refrigerant of claim 14 wherein said hydrofluorocarbon coolant is selected from the group consisting of 1,1,1,2-tetrafluoroethane, difluoromethane, and pentafluoroethane.

16. The lubricated refrigerant of claim 1 wherein said synthetic oil comprises antioxidant containing at least one phenolic hydroxyl group per molecule and polyether represented by the following general formula:

$$Z[O(AO)_mR_{11}]_p$$

wherein Z represents an alcohol residue having 1 to 8 hydroxyl groups, A represents an alkylene group having 1 to 4 carbon atoms, $R_{11}$ represents a hydrogen atom or alkyl group having 1 to 8 carbon atoms and which may be the same group or different group in each repeating unit, m and p may be satisfied within the ranges of $1 \leqq m \leqq 80$, $1 \leqq p \leqq 8$ and $1 \leqq (m \times p) \leqq 300$, there being from about 0.5 to about 5 parts by weight of said antioxidant for each 100 parts by weight of said polyether.

17. The lubricated refrigerant of claim 16 which additionally contains said hydrofluorocarbon coolant at a weight ratio of said lubricant to said hydrofluorocarbon coolant 1:99 to 99:1.

* * * * *